United States Patent [19]

Stobbart

[11] Patent Number: 4,598,893

[45] Date of Patent: Jul. 8, 1986

[54] LOCKING DEVICE

[76] Inventor: Brian C. Stobbart, 62 Yangoora Crescent, Ashmore Village, Qld. 4215, Australia

[21] Appl. No.: 783,280

[22] PCT Filed: Feb. 4, 1982

[86] PCT No.: PCT/AU82/00010

§ 371 Date: Sep. 30, 1982

§ 102(e) Date: Sep. 30, 1982

[87] PCT Pub. No.: WO82/02666

PCT Pub. Date: Aug. 19, 1982

Related U.S. Application Data

[63] Continuation of Ser. No. 432,950, Sep. 30, 1982, abandoned.

[30] Foreign Application Priority Data

Feb. 4, 1981 [AU] Australia ..... PE7477
Jun. 17, 1981 [AU] Australia ..... PE9341

[51] Int. Cl.[4] ..... A62C 23/04

[52] U.S. Cl. ..... 248/548; 248/311.2; 169/51

[58] Field of Search ..... 248/548, 313, 311.2, 248/549; 312/242; 169/51

[56] References Cited

U.S. PATENT DOCUMENTS

| | | | |
|---|---|---|---|
| 898,222 | 9/1908 | Johnson | 248/313 |
| 920,368 | 5/1909 | Mullaney | 248/548 |
| 1,129,198 | 2/1915 | Iddings | 248/311.2 |
| 1,360,829 | 11/1920 | Tunnell . | |
| 1,487,850 | 3/1924 | Miller . | |
| 1,727,213 | 9/1929 | McMullen | 248/311.2 |
| 1,816,342 | 7/1931 | Phinney . | |
| 1,917,541 | 7/1933 | Phinney . | |
| 2,234,360 | 3/1941 | Whetson | 248/311.2 |
| 2,356,276 | 8/1944 | Rossiter . | |
| 2,596,635 | 5/1952 | Wolfe | 24/500 |
| 3,042,910 | 7/1962 | Shull . | |
| 3,067,822 | 12/1962 | Hattenhauer . | |
| 3,533,526 | 10/1970 | Adell | 248/311.2 |
| 3,722,733 | 3/1973 | Neumann | 312/242 |
| 4,034,697 | 7/1977 | Russell | 169/51 |
| 4,046,439 | 9/1977 | Lee | 169/51 |

FOREIGN PATENT DOCUMENTS

| | | |
|---|---|---|
| 1047093 | 1/1979 | Canada . |
| 2047479 | 6/1972 | Fed. Rep. of Germany . |

*Primary Examiner*—Reinaldo P. Machado
*Assistant Examiner*—Alvin Chin-Shue
*Attorney, Agent, or Firm*—Cushman, Darby & Cushman

[57] ABSTRACT

A retaining device for hand-held fire extinguishers is provided with retaining means (12) co-operable with linking means (18), in the form of a dislodgable or frangible panel, and locking means (28). In normal use, article (10) is removed by unlocking the means (28). In emergency, the article is accessed via (18).

8 Claims, 11 Drawing Figures

LOCKING DEVICE

This is a continuation, of application Ser. No. 432,950, filed Sept. 30, 1982, which was abondoned upon filing hereof.

This invention relates to a retaining device siutable for use in association with articles such as wall mounted fire extinguishers and other articles particularly those articles which require storing in a public access area.

For illustrative purposes, the present invention will be described with reference to fire extinguishers. However it is to be understood that the invention is not limited to such applications and it may be used in association with whatever articles may be stored or supported in general access areas.

At present, hand-held and operated fire extinguishers are often mounted in areas accessable to the public such as on walls, either internally or externally of a building. The extinguishers are mounted by means of a bracket assembly and a fastening clip which extends around and retains the extinguisher to the bracket. A disadvantage of this arrangement is that the extinguisher may be easily tampered with and removal of the fire extinguisher from the bracket for the purpose of theft or unauthorised discharge is extremely easy. To overcome this problem, extinguishers are often arranged in a wall mounted box having a hinged glass front panel. Emergency access is gained to the extinguisher by breaking the glass at the front of the box. In such a box the hinged front is normally locked to the sides of the box such as to allow access for servicing purposes. A disadvantage of this arrangement is that the box construction is expensive, relatively large in size and lacking in aesthetic appearance. Furthermore, theft of the extinguishers from such boxes is relatively easy as most boxes include a screwed lid which may be easily unscrewed to allow access to the interior of the box.

A further disadvantage of such boxes is that when the glass at the front of the box is broken in emergency situations, pieces of the glass tend to remain fixed in the supporting frame. These glass fragments provide a dangerous protrusion to a person trying to obtain quick access to the extinguisher within the box. Additionally, such conventional boxes also do not provide full visibility of the extinguisher such that in many situations for example when one is in an emergency situation and is looking from the side or top of the box, it is difficult to locate the extinguisher or to determine whether the extinguisher is still in the box.

The present invention aims to alleviate the above disadvantages associated with fire extinguisher storage and to provide an improved locking device for use with articles such as fire extinguishers or the like. Other objects and advantages of the invention will become apparent from the following description.

With the foregoing and other objects in view this invention in one aspect resides broadly in a securing assembly for securing an article to a support in a selected location, said securing assembly including retaining means and link means co-operable therewith so as to retain said article in said selected location and said link means being removable to permit said article to be removed from said location.

According to a further aspect, this invention resides broadly in a securing assembly for securing an article to a support in a selected location, said securing assembly including:

retaining means, link means and locking means, said retaining means and said link means being co-operable to retain said article in said selected location; said locking means being releasable to permit said article to be removed from said selected location, and said link means being dislodgable to permit said article to be removed from said selected location.

Preferably the link means is formed of a frangible material whereby it may be removed or dislodged by being broken. In one form the link means has a glass panel.

Suitably the retaining means is adapted to extend part way around the article to be secured whereby the article may be removed from an operative position within the retaining means to a position remote therefrom and said link means is co-operable with said retaining means to form therewith an enclosure about the article. Alternatively, the retaining means and the link means may limit the degree of freedom of movement of an article such that the article cannot be removed from its secured location.

The locking means may be a selectively operatable lock such as a key operated lock or alternatively it may be in the form of a mechanically securable confinement which can only be removed with the aid of a particular tool or in a particular manner. It is also preferred that the retaining means be so dimentioned as to permit portions of the articles being supported thereby to be visible beyond the extremities of the securing assembly. However, if desired the retaining means may be formed to completely encompass the article being secured.

In order that the invention may be more readily understood and put into practical effect, reference will now be made to the accompanying drawings which illustrate preferred embodiments of the invention and wherein.

Figure 1:
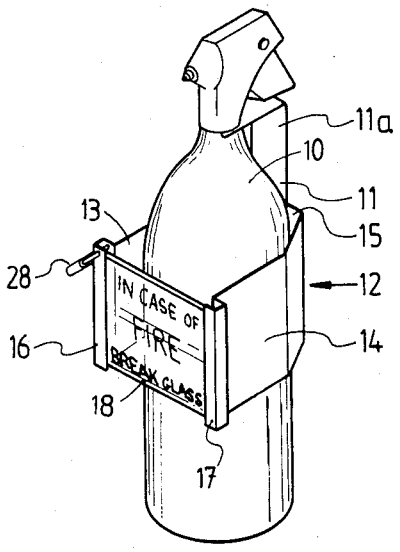
FIG. 1 is a perspective view showing a typical retaining device according to the present invention mounted about a fire extinguisher.

Referring to FIG. 1 there is illustrated a conventional hand-held fire extinguisher 10 mounted on a bracket 11 which has a top portion 11*a* which engages with the neck of the extinguisher and a lower portion (not shown) which supports a releasable clamp adopted to secure the body of the extinguisher to the bracket 11. The retaining device 12 according to the present invention is mounted about the extinguisher 10 and the bracket 11 to prevent unauthorised removal of the extinguisher.

The arrangement of such conventional brackets 11 is such that after the releasable clamp or strap fastener is released from the body of the extinguisher 10, the latter must be moved outwardly to free it from the mounting bracket 11. Such removal is prevented by the retaining device 12.

Figure 2:
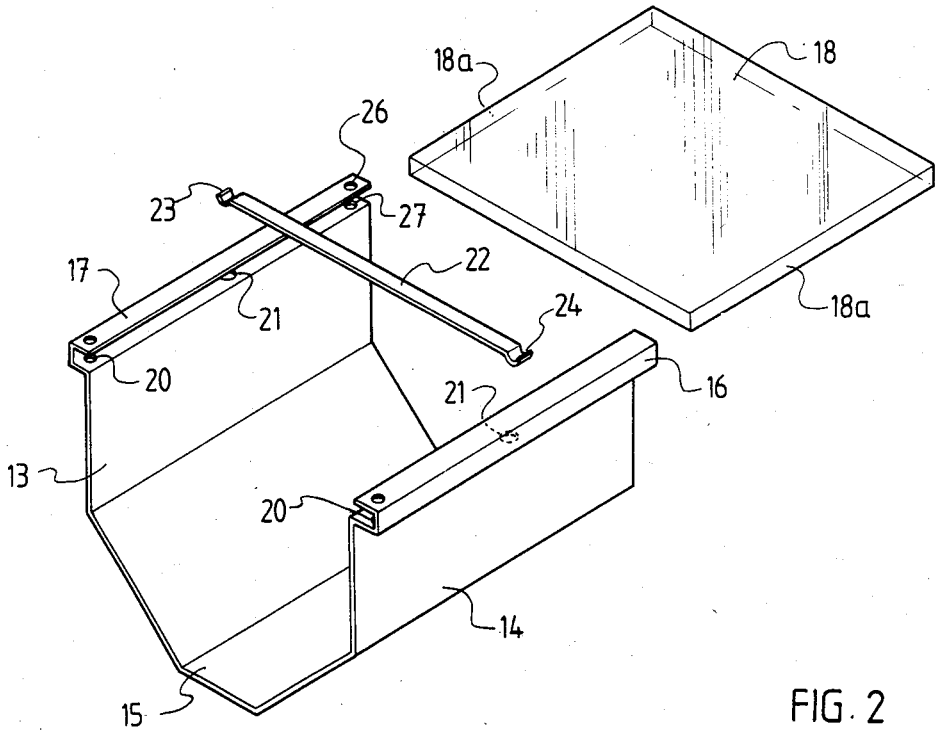
FIG. 2 is an exploded view of the locking device illustrated in FIG. 1.

As is clearly illustrated in FIG. 2, the locking device 12 is generally channel-shaped in cross-section and includes a pair of outwardly diverging walls or arms 13 and 14 extending from a base portion 15 which is adapted to be supported behind or to the support bracket 11 such that it is secured fixedly to the wall or other mounting surface. The walls 13 and 14 extend outwardly on either side of the extinguisher 10 mounted on the support bracket 11 in the manner illustrated in FIG. 1. Preferably the device is formed of stainless steel and as shown, the top and bottom of the extinguisher extend beyond the device 12 and are thus visible from all directions. The free edges of each side wall 13 and 14 are bent outwardly to define opposite channel portions 16 and 17 respectively which are adapted to receive the side edges 18*a* of a fracturable panel 18 suitably formed of glass or the like or other dislodgable member.

Each channel portion 16 and 17 has an aperture 21 formed substantially centrally in the back flange thereof and a reinforcing strip 22 is provided for engagement within the respective apertures 21. The strip 22 includes tag portions 23 and 24 at each end which engage within the respective apertures 21. Preferably the tag 23 is formed into a dog leg shape whilst the other tag 24 is formed into a cam surface in the manner illustrated. The tags 23 and 24 are spaced apart a distance slightly less than the distance between the apertures 21 such that when the tags 23 and 24 are moved into engagement with the respective apertures 21, the walls 13 and 14 of the channel will be forced inwardly into a slightly stressed state. This action is facilitated by the cam surface of the tag 24. The strip 22 prevents the walls 13 and 14 being flexed outwardly to free the panel edges 18*a* from the channel portions 16 and 17.

When it is desired to lock the extinguisher in position, the strip 22 is firstly engaged with the respective apertures 21 to pull the walls 13 and 14 slightly inwardly. The rectangular piece of glass 18 or other frangible material is then slid or moved into engagement with the channel portions 16 and 17 until it rests against the lower stop member 20 which may be a rivet passing through the flanges of the respective channel portions 16 and 17 as illustrated. The locking strip is then retained in its operative position since the glass 18 prevents disengagement of the tag portions 23 and 24 from the aperture 21. A padlock 28 may be engaged through the aligned apertures 26 and 27 in the spaced flanges of one channel portion 16 and positioned above the upper edge of the panel 18 to lock the glass in place.

When it is desired to gain access to the fire extinguisher for servicing purposes, the padlock 28 is removed so that the panel 18 can be withdrawn from the device 12. The walls 13 and 14 will then tend to move slightly outwardly and the camming surface of the tag 24 will cause disengagement between the tag 24 and its associated aperture 21. The strip 22 will then normally pivot downwardly about the tag 23 which will be retained in its aperture 21. Free access can then be had to the extinguisher 10. If the extinguisher is required in an emergency, the glass panel 18 may be dislodged such as by being smashed and the broken pieces and fragments thereof will fall in an unimpeded manner downwardly so that no broken fragments will present a danger to the user. Breaking of the glass will also cause the locking strip to spring outwardly at the cam end and pivot downwardly so that free access can be had to the extinguisher. Any attempt to illegally remove the extinguisher by breaking of the glass will result in alerting persons to the presence of an intruder. As stated previously, the device 12 is mounted behind or to the conventional extinguisher mounting bracket. For this purpose, the base 15 is provided with apertures which may be aligned with apertures in the bracket so that one set of screws may be passed therethrough to mount the bracket and device to a wall or the like. The screws are so situated as to be behind the extinguisher 10 when the extinguisher 10 is mounted to the bracket 11. This ensures that the bracket 11 or device 12 cannot be removed from a wall unless the extinguisher is first removed from its bracket 11. Unauthorised discharge of the extinguisher is provided by either forming the bracket such that the trigger is retained by the bracket and cannot be actuated until the extinguisher is removed or by positioning the trigger locking pin head against the mounting surface whereby it is inaccessible so that the extinguisher cannot be discharged without first removing it from its supported attitude in the device of the present invention.

In an alternative arrangement for use with an alternative mounting bracket, a hasp is provided on the base wall of the device. Such an alternative bracket includes a pair of mounting apertures at each end thereof and an intermediate shoulder. To mount the locking device to the bracket, the lower pair of bracket mounting screws are removed and the free end of the bracket passed between the hasp and base wall until the hasp abuts the bracket shoulder. The screws may then be re-affixed. The abutment between the hasp and bracket shoulder prevents upward movement of the locking device 12.

The arrangement illustrated in FIG. 1 is such that full visibility of the top and bottom of the extinguisher 10 is provided from all viewing positions. Further, the conventional extinguisher clip which attaches the extinguisher to the bracket may be eliminated if the glass panel 18 is arranged at such a close proximity to the extinguisher that it prevents any substantial outward movement thereof.

In lieu of the padlock, the glass panel may be retained by a spring clip or other device which permits the glass to be slid into position whereupon the clip will move to an operative position behind the glass to prevent its removal. A screw fastening could also be provided for this purpose. However it is preferred that whatever locking device is employed it is arranged for unlocking or release by authorised persons only or persons equipped with the necessary know-how or equipment. Also, the channel shaped bracket could be made sufficiently rigid to prevent the opposite sides being sprung to release the glass. Of course for this purpose the bracket could be formed of tubular material or otherwise as desired. Additionally, in installations in which the article being secured does not require servicing, the releasable locking means may be omitted so that the only way to release the article thereby secured is to break or dislodge the link member interconnecting the side panels of the device or other retaining means as desired.

Figure 3:
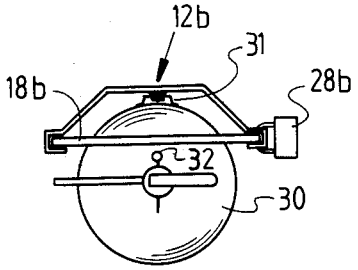
FIGS. 3, 4 and 5 are respective plan, elevation and side views of a retaining device for use with a large fire extinguisher.
Figure 4:
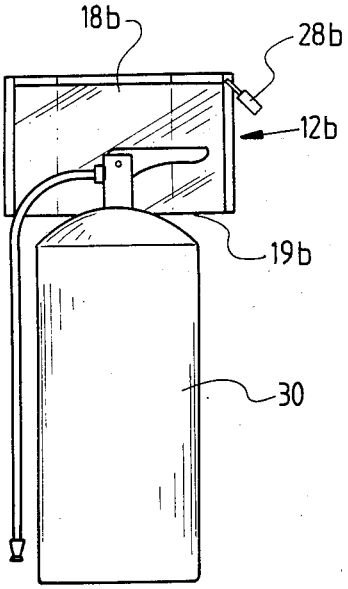
Figure 5:
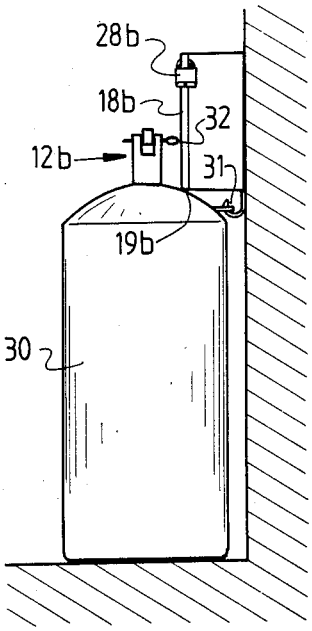

In an alternative arrangement shown in FIGS. 3, 4 and 5, the locking device 12*b* is illustrated associated with a large fire extinguisher 30. In such case, the fire extinguisher 30 is normally provided with a conventional hook type bracket 31. This is mounted to or adjacent the base of the locking device as illustrated in the drawings. The locking device is substantially of the same form as that described above. However in this embodiment the extinguisher is engaged beneath the lower edge 19*b* of the glass panel 18*b* which is fitted to the device 12*b* and locked in position by the lock 28*b* as aforesaid. This will prevent removal of the extinguisher from its supporting bracket 31 unless the panel is broken or itself removed as the extinguisher must be lifted to be freed from the bracket 31. Furthermore as illustrated in FIGS. 3 and 5, the locking pin 32 associated with the handle of the extinguisher will be unable to be withdrawn as it is disposed adjacent to the glass panel 18*b*. This will prevent unauthorised operation of the extinguisher.

Figure 6:
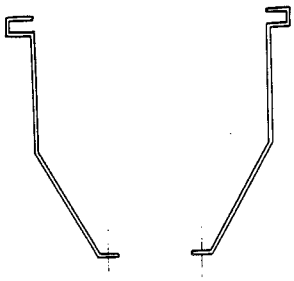
FIGS. 6 and 7 are end views illustrating further alternative body assemblies for retaining devices according to a further aspect of the invention.
Figure 7:
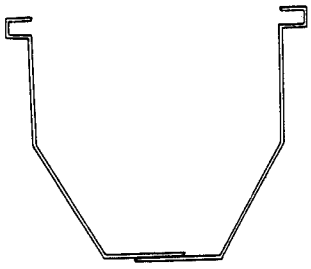

FIGS. 6 and 7 illustrate alternative arrangements which may be used for mounting the frangible glass panel. In FIG. 6 the channel is eliminated and replaced with two extruded or otherwise fabricated sections which may be individually affixed to the wall. In FIG. 7 the channel is formed in two parts, slidable relative to each other and lockable in a desired position so as to accommodate different sizes of extinguisher.

Figure 8:
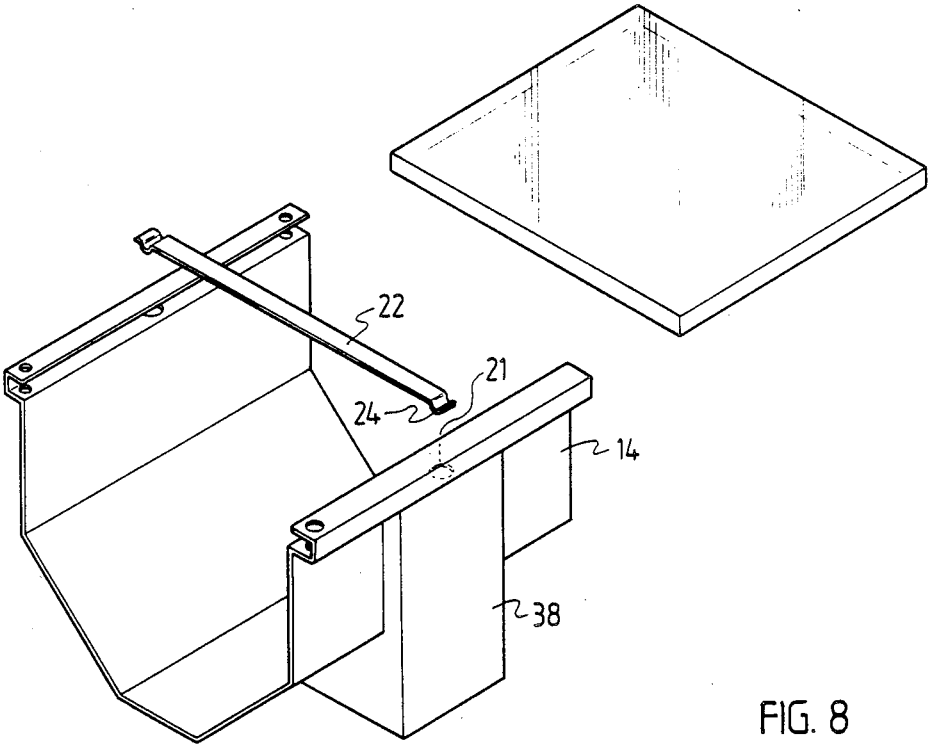
FIG. 8 is a perspective view showing the locking device associated with an alarm.

If required an alarm can be fitted to the system such as by use of an alarm box 38 of the type shown in FIG 8. The alarm box 38 is fitted to the outer side of one wall 14 of the device and includes a microswitch the operating portion or button of which is aligned with the aperture 21. Engagement of the camming projection 24 of the locking strip 22 within its respective aperture 21 and consequently with the micro-switch actuating lever, will cause the deactivation of the switch whilst withdrawal of the strip and camming projection will cause the switch to operate. This of course will occur automatically when the glass is broken. The switch may be used to switch an alarm to either indicate a fire or the presence of an intruder. The switch may also be used in place of a manual call point so that actuation thereof will result in a signal being transmitted to the fire brigade. Thus, a dual function is provided which may result in a critical saving in time in summonsing the fire brigade in emergency situations. Of course, the switch may be mounted in any convenient fashion. In an alternative arrangement, the switch may include an activating lever which will be contacted by the glass when the glass is in its operative position so as to deactivate the switch. Breaking of the glass and subsequent fallaway will then cause the switch to activate automatically. Alternatively a magnetically actuated reed switch may be utilized. In such arrangement the reed switch could be deactivated by the presence of a magnetic body, e.g. a fire extinguisher, and activated upon removal of that body.

Figure 9:
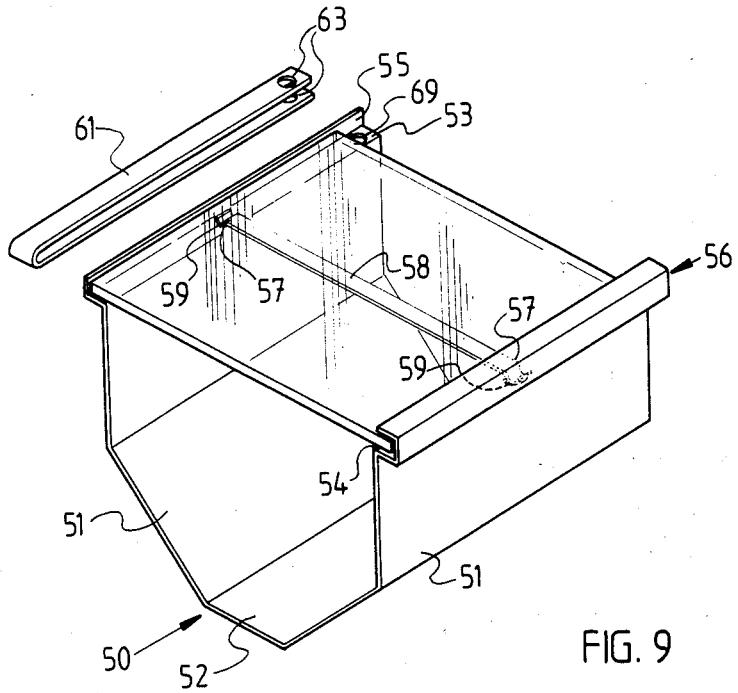
FIG. 9 illustrates a further embodiment of the invention.

FIG. 9 illustrates a further embodiment of the invention adapted for manufacture utilizing basic sheet metal working equipment which in general cannot be utilized to fold the channel shaped bracket illustrated in FIGS. 1 and 2 and incorporating a channel section at each free edge. As shown, the retaining device 50 is generally channel shaped in cross-section and has a pair of outwardly diverging walls 51 extending from a base wall 52 which is adapted to be mounted behind the normal fire extinguisher support bracket such that the opposite walls 51 of the locking device 50 are disposed on either side of an extinguisher mounted on the support bracket. The free edges of each side wall 51 are bent outwardly to define opposite ledge portions 53 and 54 respectively, the ledge portion 53 being bent upwardly to provide a stop member 55 and the ledge portion 54 on the opposite side of the locking device being bent in the manner shown to form a channel 56 the purpose of which will hereinafter become apparent.

Each ledge portion 53 and 54 has an aperture 57 formed centrally thereof and a locking strip 58 is also provided, the strip 58 having tags 59 as shown in FIG. 9 at its opposite ends each adapted to engage with a respective aperture 57 whereby to prevent the walls 51 of the locking device 50 from moving outwardly. A rectangular piece of glass 60 is then placed over the locking strip to be supported on the respective ledge portions 53 and 54 in the manner shown, one edge of the glass being closely received within the channel 56 and the other edge being substantially in engagement with the stop member 55. A locking bar 61 of generally U-shaped form is adapted to be engaged about the ledge portion 53 and the adjacent edge of the glass 60 and the free ends of the locking bar have apertures 63 which may be aligned with the aperture 69 so as to receive a conventional lock to lock the glass 60 to the walls 51. When the device is in its substantially vertical operative attitude, the lock ensures that the glass will not drop out whilst the U-shaped bar 61 ensures that the glass cannot be withdrawn upwardly. The stop member 55 is of greater height than the thickness of the glass panel 18 so that it also acts as a stop to the U-shaped bar 25 to prevent it being moved or pivoted outwardly.

To gain access to the fire extinguisher for servicing purposes, the conventional lock is remvoed from the locking bar apertures 63 so that the locking bar 62 can be removed from engagement with the glass 60 and ledge portion 53. The glass 60 can then be removed and then the locking strip 58 such as to allow access to the extinguisher.

If the extinguisher is required in an emergency the glass 60 is broken such as to allow removal of the locking strip 58 and access to the extinguisher. The side walls 51 of the device are so sized that the extinguisher cannot be removed from its conventional bracket without removal of the glass 60 and the locking bar 58. Any attempt to illegally remove the extinguisher by breaking of the glass 60 will result in alerting persons to the presence of the intruder.

Figure 10:
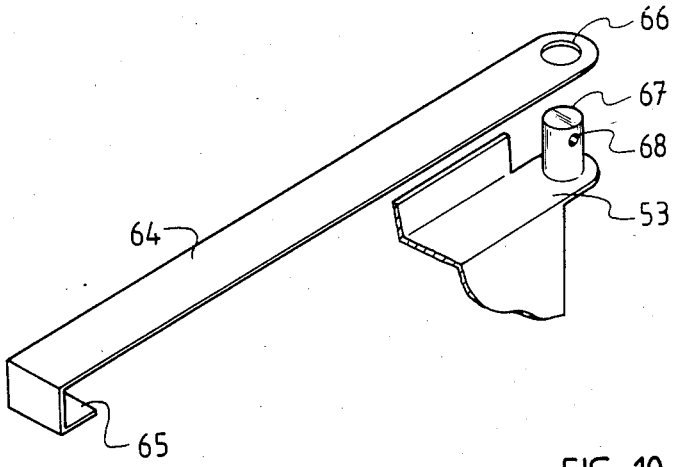
FIG. 10 illustrates an alternative locking bracket for use with the embodiment illustrated in FIG. 9.

As an alternative to the U-shaped locking bar 61, a bar 64 of the type shown in FIG. 10 may be employed. This bar 64 has U-shaped portion 65 at one end thereof adapted to be engaged about the glass 60 and ledge portion 53 and an aperture 66 at the other end adapted to be engage with an upstanding post 67 fixed to the ledge portion 53. The post 67 has an aperture 68 therein which is adapted to receive a conventional lock so that the glass is locked to the ledge portion 53.

Figure 11:
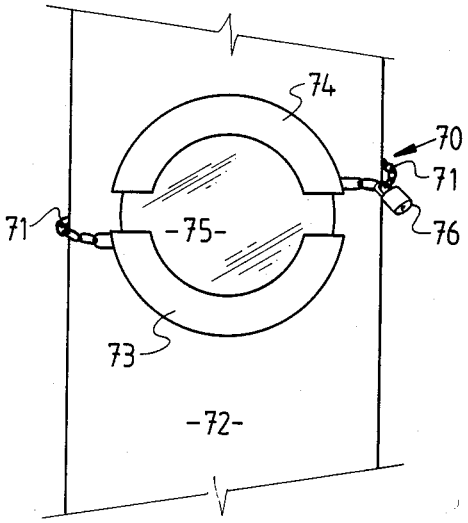
FIG. 11 illustrates yet a further embodiment of the invention.

In a further embodiment of the invention illustrated in FIG. 11, the locking device 70 includes a chain or cable 71 which extends about the article 72 and its associated mounting structure and the opposite free ends of which are connected to respective members 73 and 74 of channel shaped cross-section which, in this embodiment, are arcuate in form and are interconnected by means of a piece of glass 75 which is adhered to each arcuate channel member. One end of the chain or cable is preferably attached to one arcuate channel member by means of conventional lock 76 so that access may be gained to the fire extinguisher for servicing purposes.

In an emergency, all that is necessary is that the glass 75 be broken which will thus disconnect the arcuate channel members and allow access to the extinguisher. However, the fact that the glass has to be broken before access can be gained to the article will deter thieves. Of course, the members 73 and 74 may be of any form. The glass has to be broken to allow access to the extinguisher in emergency situations whilst any attempt to steal the extinguisher will also require the glass to be broken which will alert persons to the presence of the theft or unauthorised use of the article.

It will be seen that the present invention provides a maintenance free and compact and aesthetically pleasing device which may be mounted in any desired position and which is suitable particularly where limited space is available. The sides of the device may be made either rigid or flexible whilst the whole device may be made in one piece as part of an existing fire extinguisher bracket. Further, the locking devices may be easily stacked for transporting purposes and easily mounted to existing fire extinguishers. The device is also suitable for locking other similarly mounted apparati, as well as all types of extinguishers.

The articles which may be retained by devices of the present invention could be for example dispensing bottles of spirits which for sales purposes have to be visible while at the same time requiring retaining means for safe keeping, or communication equipment. Furthermore the device may be made to extend the full length of the article being retained and if used in exposed locations a suitable top shield may be incorporated into the device.

Whilst the above has been given by way of illustrative example of the invention, it should be realised that many variations and modifications may be made thereto by persons skilled in the art without departing from the broad scope and ambit of the invention as is defined in the appended claims.

I claim:

1. A bracket assembly for securing a fire extinguisher assembly comprising a fire extinguisher and associated holding means, to a supporting surface, said bracket assembly including a bracket in which said holding means may be secured to a supporting surface and a breakable panel for securing the extinguisher in said bracket, the latter being an open ended channel shaped bracket formed to partly surround the fire extinguisher assembly to be secured thereby and to leave the end portions of the fire extinguisher visible beyond the open ends of said bracket and having a pair of spaced apart free edge portions extending between said open ends and each said free edge portion being provided with channel supporting means supporting respective opposed side portions of said breakable panel and between which the fire extinguisher may pass from and into said channel shaped bracket and releasable locking means engaged with said bracket to prevent release of said breakable panel from said supporting means and thereby in use prevent release of a fire extinguisher from its associated holding means secured within said bracket without either breaking said breakable panel or releasing said locking means and said breakable panel from said supporting means.

2. A bracket assembly according to claim 1 wherein said breakable panel is slidably received in said channels.

3. A bracket assembly according to claim 1, wherein said bracket includes a base wall portion engageable against a supporting surface and apertured to permit mechanical fastening means to pass from said holding means through the apertures in said base wall portion and into the supporting surface.

4. A bracket assembly according to claim 1, wherein said bracket is formed from a flexible material and there is provided a strip to maintain said supporting channels engaged about said side portions and having opposite end projections engaged in apertures formed in said supporting channels and said strip being held engaged in said apertures by said panel.

5. A bracket assembly according to claim 1, wherein said bracket is a rigid bracket.

6. A bracket assembly according to claim 1, wherein said holding means includes a clip which has to be released to free the extinguisher therefrom and wherein said breakable panel precludes access to said clip.

7. A bracket assembly according to claim 6, wherein said bracket includes a catch portion which locates about the fire extinguisher to prevent vertical movement of the extinguisher.

8. Bracket means for preventing removal of an article from means supporting the article comprising:

a retaining assembly securable to the supporting means and engageable with or by the article to prevent removal thereof from the supporting means, said assembly including:

a retaining bracket formed of a flexible material and having a base portion adapted to be secured to the supporting means and spaced flanges extending away from said base portion and having free edges each comprising a channel portion;

link means including a frangible panel forceably dislodgeable or freely removable from said assembly to enable removal of the article from the supporting means, said channel portions being adapted to slidably receive respective edge portions of said frangible panel to retain the same;

said link means further including a catch assembly comprising a strip adapted to extend between said flanges and having opposite end projections adapted to engage in respective apertures formed in said channel portions to maintain the same engaged about said edge portions, said strip in use being held by said panel in operative engagement with said apertures; and lock mounting means for reception of releasable locking means engageable with said panel and said bracket to lock said panel to said bracket to prevent free removal of said panel but being releasable to enable free removal of said panel from said bracket.

* * * * *